US008209818B2

(12) United States Patent
Lin

(10) Patent No.: US 8,209,818 B2
(45) Date of Patent: Jul. 3, 2012

(54) TOOL HANDLE UNIT

(75) Inventor: Jack Lin, Taichung (TW)

(73) Assignee: Yih Cheng Factory Co., Ltd., Taichung (TW)

( * ) Notice: Subject to any disclaimer, the term of this patent is extended or adjusted under 35 U.S.C. 154(b) by 198 days.

(21) Appl. No.: 12/764,921

(22) Filed: Apr. 21, 2010

(65) Prior Publication Data

US 2011/0258809 A1 Oct. 27, 2011

(51) Int. Cl.
*B25G 1/10* (2006.01)

(52) U.S. Cl. ..... 16/436; 16/111.1; 16/900

(58) Field of Classification Search ..... 16/111.1, 16/430, 436, 438, 900; 81/177.4, 177.8, 81/177.7, 489, 490; 408/241 R
See application file for complete search history.

(56) References Cited

U.S. PATENT DOCUMENTS

| | | | | |
|---|---|---|---|---|
| 5,123,768 | A * | 6/1992 | Franklin | 403/96 |
| 6,189,420 | B1 * | 2/2001 | Shiao | 81/60 |
| 6,386,075 | B1 * | 5/2002 | Shiao | 81/177.8 |
| 6,401,301 | B1 * | 6/2002 | Hung | 16/430 |
| 6,520,053 | B2 * | 2/2003 | Liao | 81/177.9 |
| 6,629,801 | B2 * | 10/2003 | Cheng | 403/101 |
| 6,877,186 | B2 * | 4/2005 | Shiao | 16/111.1 |
| 7,047,846 | B1 * | 5/2006 | Hu | 81/177.7 |
| 2006/0138792 | A1 * | 6/2006 | Heneveld | 294/53.5 |
| 2007/0214607 | A1 * | 9/2007 | Lin | 16/438 |

FOREIGN PATENT DOCUMENTS

GB 2400812 A * 10/2004

* cited by examiner

*Primary Examiner* — Chuck Y. Mah

(57) ABSTRACT

A handle unit includes a handle, a connector, a bolt, a latch, a button and a spring. The handle includes two lugs. The connector includes a lug. The lug of the connector is located between the lugs of the handle. The bolt is inserted in the lugs so that the handle is pivotally connected to the connector. The latch is connected to the bolt and located in a non-circular opening of the second lug of the handle. The button is connected to the bolt. The spring is compressed between the button and the first lug of the handle to make the latch partially enter a non-circular opening of the connector to position the connector relative to the handle. The button can be pressed to make the latch leave the non-circular opening of the connector.

11 Claims, 8 Drawing Sheets

TOOL HANDLE UNIT

BACKGROUND OF INVENTION

1. Field of Invention

The present invention relates to a tool and, more particularly, to a tool including a handle unit for connection to a chuck for holding a bit.

2. Related Prior Art

As disclosed in Taiwanese Patent Publication No. 313035, a handle unit includes a connector 6 for pivotally connecting a cylinder 2 to a handle 66. The connector 6 includes an insert 65 formed at an end and a lug 61 formed at an opposite end. The insert 65 is inserted in the handle 66. The lug 61 is pivotally connected to the cylinder 2. Two spring-biased detents 67 are connected to the connector 6. The cylinder 2 includes two lugs each including recesses 27 for receiving the spring-biased detents 67 for positioning the cylinder 2 relative to the connector 6. The handle 66 is however solid and cannot store bits. Furthermore, the positioning of the cylinder 2 relative to the connector 6 is not firm attributed to the nature of the spring-based detents 67.

As disclosed in Taiwanese Utility Model No. 574966, a handle 5 is connected to a chuck 6 through a connector 30. The handle 5 includes a chamber defined therein. The chamber is closed by a cover 503. The connector 30 includes an insert 31 formed at an end and two jaws 32 formed at an opposite end. The insert 31 is inserted in the handle 5. The jaws 32 are connected to the chuck 6. The cover 503 is however solid and cannot store bits. Moreover, the connector 30 is not pivotally connected to the chuck 6.

The present invention is therefore intended to obviate or at least alleviate the problems encountered in prior art.

SUMMARY OF INVENTION

The primary objective of the present invention is to provide a handle unit for firmly holding a chuck at various angular positions relative thereto.

To achieve the foregoing objective, the handle unit includes a handle, a connector, a bolt, a latch, a button and a spring. The handle includes a first lug and a second lug with a non-circular opening defined therein. The connector includes a lug with a non-circular opening defined therein. The lug of the connector is located between the lugs of the handle. The bolt is inserted in the lugs so that the handle is pivotally connected to the connector. The latch is connected to the bolt and located in the non-circular opening of the handle. The button is connected to the bolt. The spring is compressed between the button and the first lug of the handle to make the latch partially enter the non-circular opening of the connector to position the connector relative to the handle. The button can be pressed to make the latch leave the non-circular opening of the connector to allow rotation of the connector on the handle.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
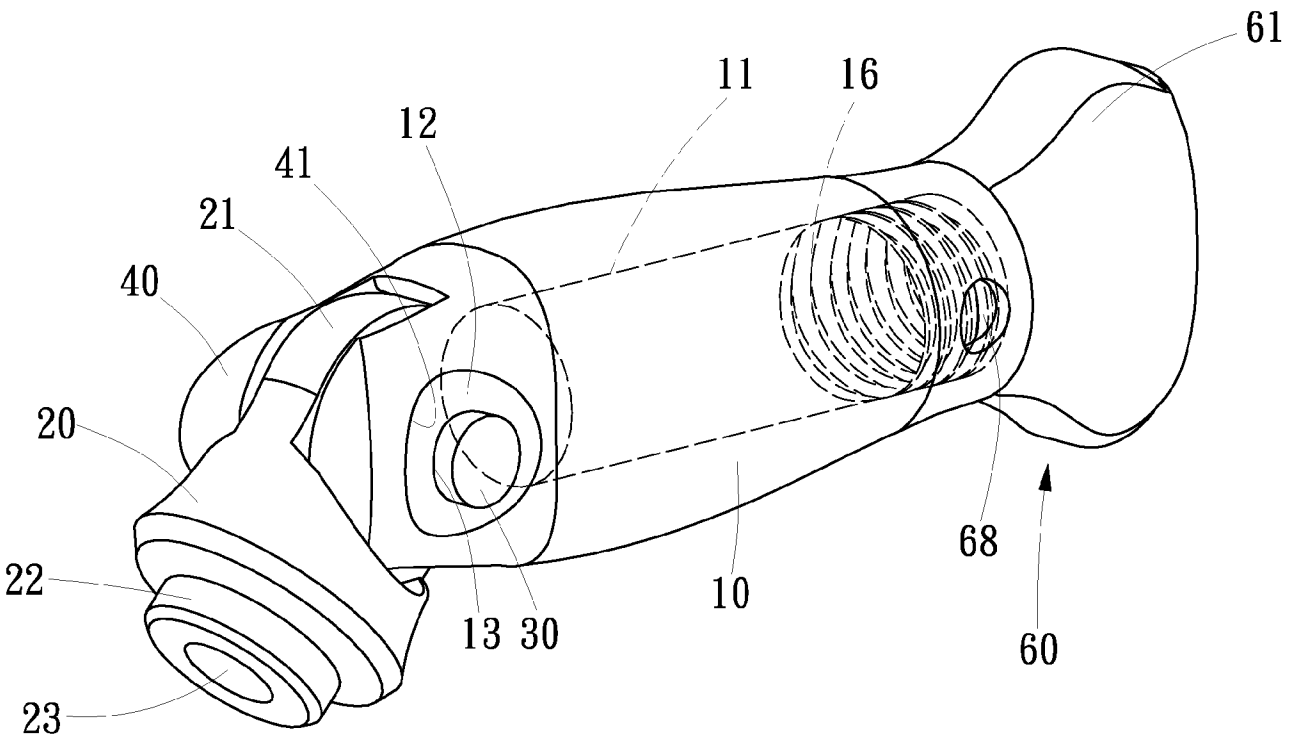
FIG. 1 is a perspective view of a handle unit according to the preferred embodiment of the present invention.
Figure 2:
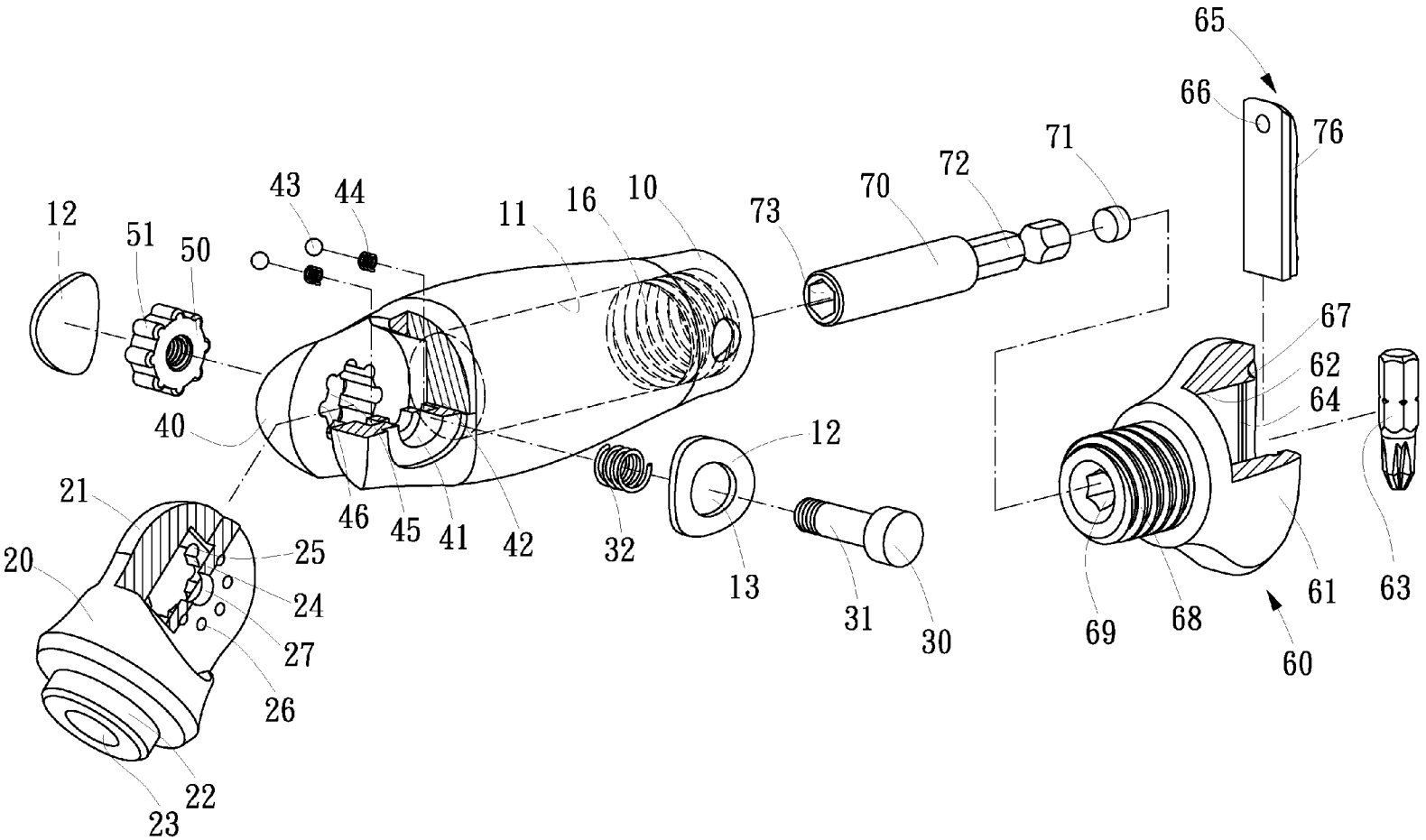
FIG. 2 is an exploded view of the handle unit shown in FIG. 1.

Referring to FIGS. 1 and 2, a handle unit includes a handle 10, a connector 20, a bolt 31 for pivotally connecting the connector 20 to the handle 10, the latch 50 engaged with the bolt 31, and a tail element 60 connected to the handle 10 according to the preferred embodiment of the present invention. The handle 10 includes a chamber 11 defined therein. The chamber 11 includes a closed end and an open end. The handle 10 includes a thread 16 formed on an internal side near the open end and first and second lugs 40 formed on an external side near the closed end.

The first lug 40 includes a countersink 41 defined therein and two recesses 42 defined in a side. The countersink 41 is located between the recesses 42. The second lug 40 includes a circular aperture 45 defined therein and cutouts 46 in communication with the circular aperture 45. The circular aperture 45 and the cutouts 46 together make a non-circular opening. The circular aperture 45 is located corresponding to the countersink 41.

The connector 20 includes a lug 21 and a stepped section 22 extending opposite to the lug 21. The lug 21 is flat element formed with a semi-circular edge. The connector 20 further includes a chamber 23 defined therein between two first and second walls. A central aperture 27 and eccentric apertures 26 are defined in the first wall of the chamber 23. The eccentric apertures 26 are located around the central aperture 27. A circular aperture 24 and cutouts 25 are defined in the second wall of the chamber 23. The circular aperture 24 is in communication with the cutouts 25. The circular aperture 24 and the cutouts 25 together make a non-circular opening. The apertures 26, 27, 24 and the cutouts 25 are in communication with the chamber 23. The circular aperture 24 is made corresponding to the circular aperture 45. The cutouts 25 are made corresponding to the cutouts 46.

The bolt 31 is preferably a threaded bolt. A button 30 is formed at an end of the bolt 31. The button 30 is made corresponding to a large section of the countersink 41. The bolt 31 is made corresponding to a small section of the countersink 41.

The latch 50 is preferably a nut for engagement with the bolt 31. The latch 50 includes ribs 51 evenly formed on the periphery thereof. The latch 50 is made corresponding to the circular aperture 45. The ribs 51 are made corresponding to the cutouts 46.

The tail element 60 includes a ridge 61 formed at an end and a thread 68 formed at an opposite end. The ridge 61 includes a chamber 62 defined therein between two walls. A groove 64 is defined in a side of each of the walls of the chamber 62. The grooves 64 face each other. A recess 67 is defined in the ridge 61. The tail element 60 includes a non-circular and preferably hexagonal bore 69 defined therein. The hexagonal bore 69 is separated from the chamber 62.

There is provided a cover 65 formed with a boss 66 and two flanges 76. The boss 66 is formed on a front face of the cover 65. Each of the flanges 76 extends only an edge of the cover 65. The boss 66 is made corresponding to the recess 67. The flanges 76 are made compliant to the grooves 64.

There is provided an extensive rod 70. The extensive rod 70 includes a non-circular and preferably hexagonal insert 72 at an end and a non-circular and preferably hexagonal socket 73 at an opposite end. A magnet 71 is secured to the non-circular insert 72.

In assembly, a spring 44 and a ball 43 are sequentially located in each of the recesses 42 so that the spring 44 is compressed between the ball 43 and a closed end of the recess 42. The lug 21 is located between the first and second lugs 40. The lug 21 is located against the balls 43, which is biased by the springs 44.

The bolt 31 is inserted in the chamber 23 through a spring 32, the countersink 41 and the aperture 27. The spring 32 is compressed between the button 30 and an annular shoulder formed between the large and small sections of the countersink 41.

The latch 50 is located in the chamber 23 through the circular aperture 45 while the ribs 51 are located in the cutouts 46. The latch 50 is engaged with the bolt 31. Thus, the connector 20 is connected to the handle 10 pivotally. A cover 12 is fit in a cavity in communication with the circular aperture 45 so that the latch 50 is covered by the cover 12. The button 30 is located in an aperture 13 defined in the cover 12.

The extensive rod 70 can be stored in the chamber 11 of the handle 10. The thread 68 of the tail element 60 is engaged with the thread 16 of the handle 10. Thus, the rod 70 is retained in the chamber 11.

Bits such as screwdrivers 63 can be stored in the chamber 62 of the tail element 60. The flanges 76 can be moved in and long the grooves 64 so that the boss 66 can be located in the recess 67. Thus, the screwdrivers 63 can be retained in the chamber 62.

Figure 3:
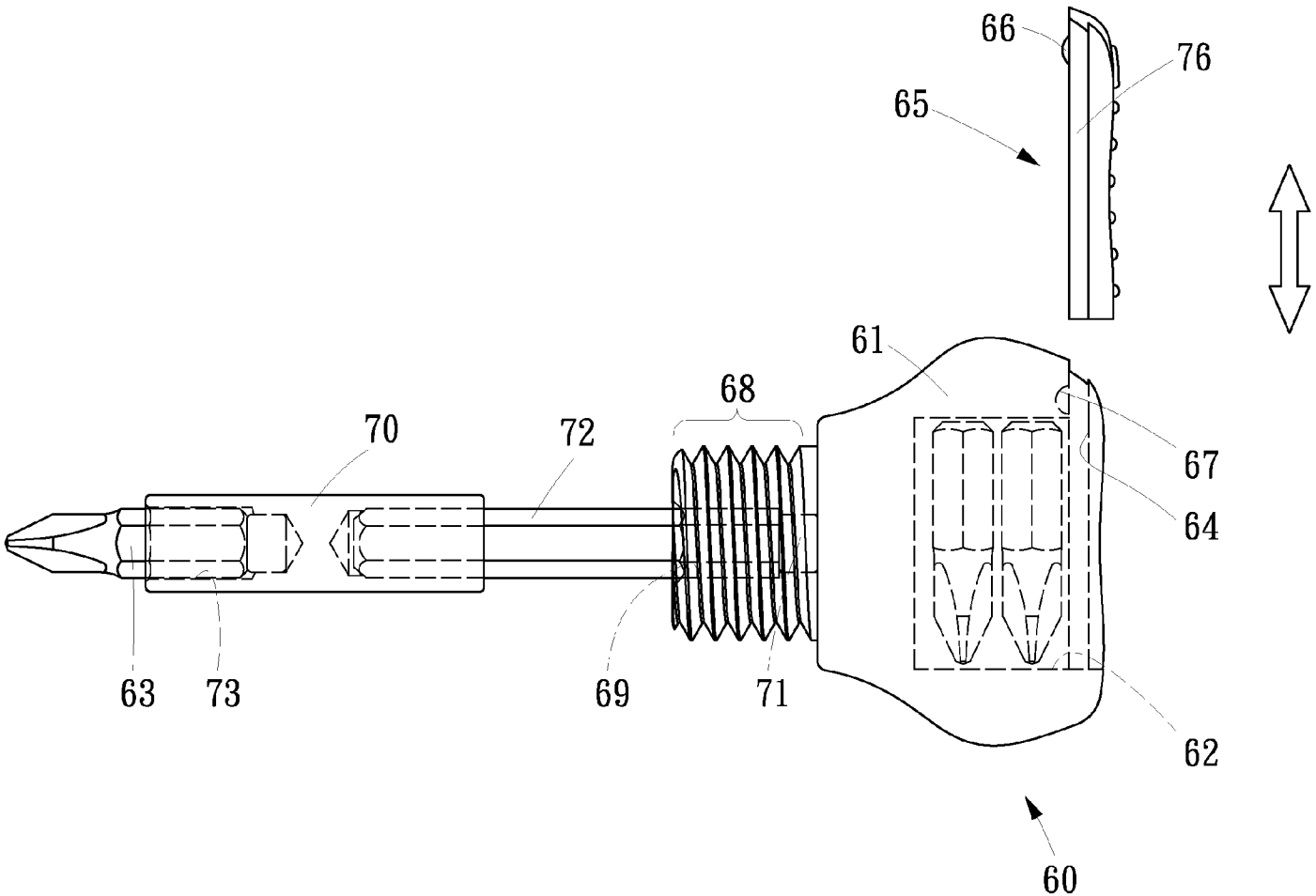
FIG. 3 is a side view of a tail element of the handle unit shown in FIG. 2.

Referring to FIG. 3, the extensive can be connected to the tail element 60 for use. In this case, the non-circular insert 72 of the extensive rod 70 is inserted in the non-circular bore 69 of the tail element 60. Thus, the tail element 60 is operable to rotate the extensive rod 70.

Figure 4:
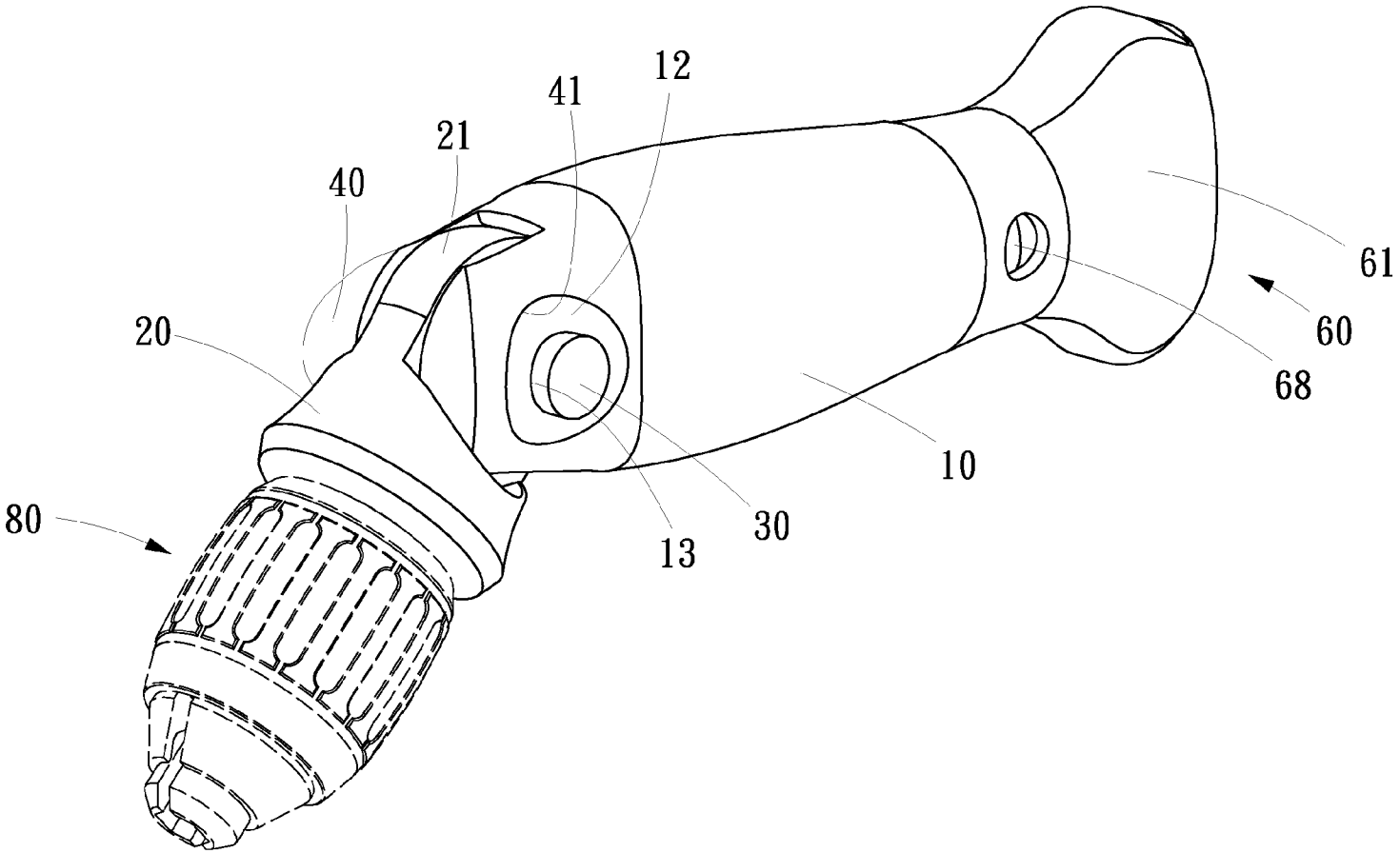
FIG. 4 is a perspective view of a chuck connected to the handle unit shown in FIG. 1.
Figure 5:
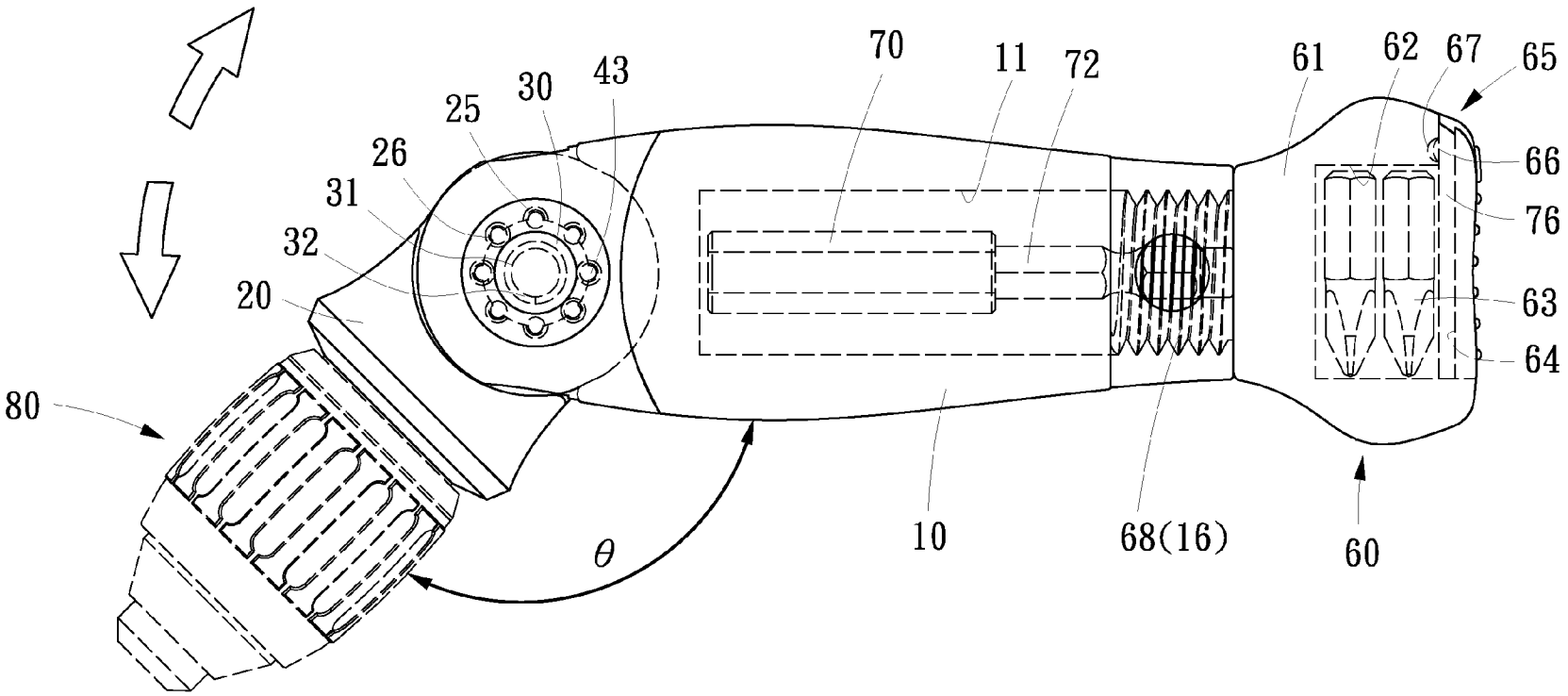
FIG. 5 is a side view of the chuck and the handle unit shown in FIG. 4.

Referring to FIGS. 4 and 5, a chuck 80 is pivotally connected to the handle 10 through the connector 20. Details of the pivotal connection of the chuck 80 to the handle 10 through the connector 20 will be described in detail.

Figure 7:
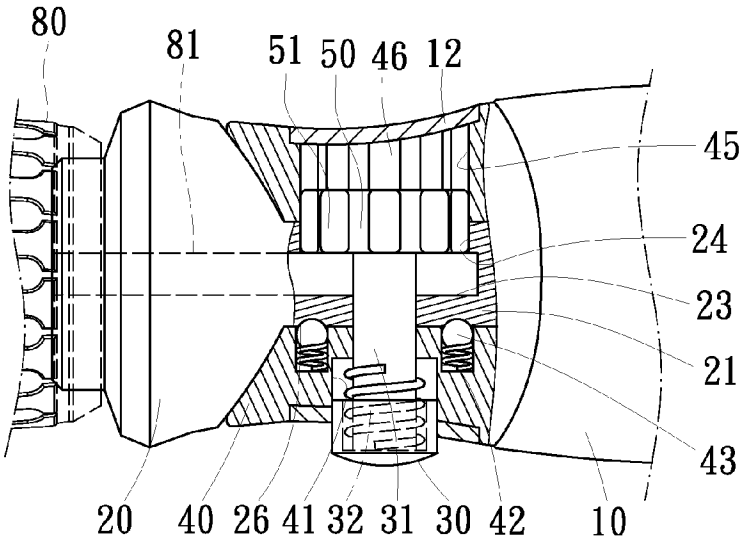
FIG. 7 is a cutaway view of the handle unit in another position than shown in FIG. 6.
Figure 6:
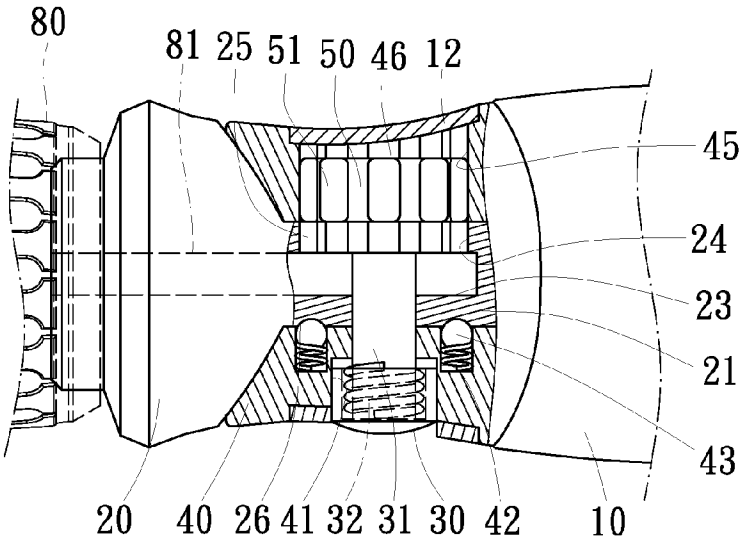
FIG. 6 is a cutaway view of the handle unit shown in FIG. 4.

Referring to FIGS. 6 and 7, the chuck 80 includes a flat insert 81. The insert 81 is made corresponding to the chamber 23. Further details of the chuck 80 will be given for not being the spirit of the present invention. The insert 81 is inserted in the chamber 23 before the bolt 31 is inserted in an aperture defined in the insert 81. Thus, the chuck 80 is connected to the handle 10 through the connector 20. The chuck 80 cannot be spun relative to the connector 20 because both the insert 81 and the chamber 23 are flat.

Referring to FIG. 6, the button 30 is pushed and the spring 32 is compressed. The bolt 31 and the latch 50 are moved. The ribs 51 of the latch 50 are located out of the cutouts 25 of the connector 20 completely. Hence, the chuck 80 can be pivoted relative to the handle 10 through the connector 20.

As the connector 20 is pivoted relative to the handle 10, the balls 43 enter and leave the apertures 26. When the balls 43 enter two related ones of the apertures 26, the cutouts 25 are aligned with the cutouts 46. Now, the ribs 51 of the latch 50 are ready to enter the cutouts 25 of the connector 20.

Referring to FIG. 7, the button 30 is released. The bolt 31 and the latch 50 are returned to their original position by the spring 32. The ribs 51 of the latch 50 are located in the cutouts 25 of the connector 20 again. Hence, the chuck 80 cannot be pivoted relative to the handle 10 via the connector 20.

Figure 8:
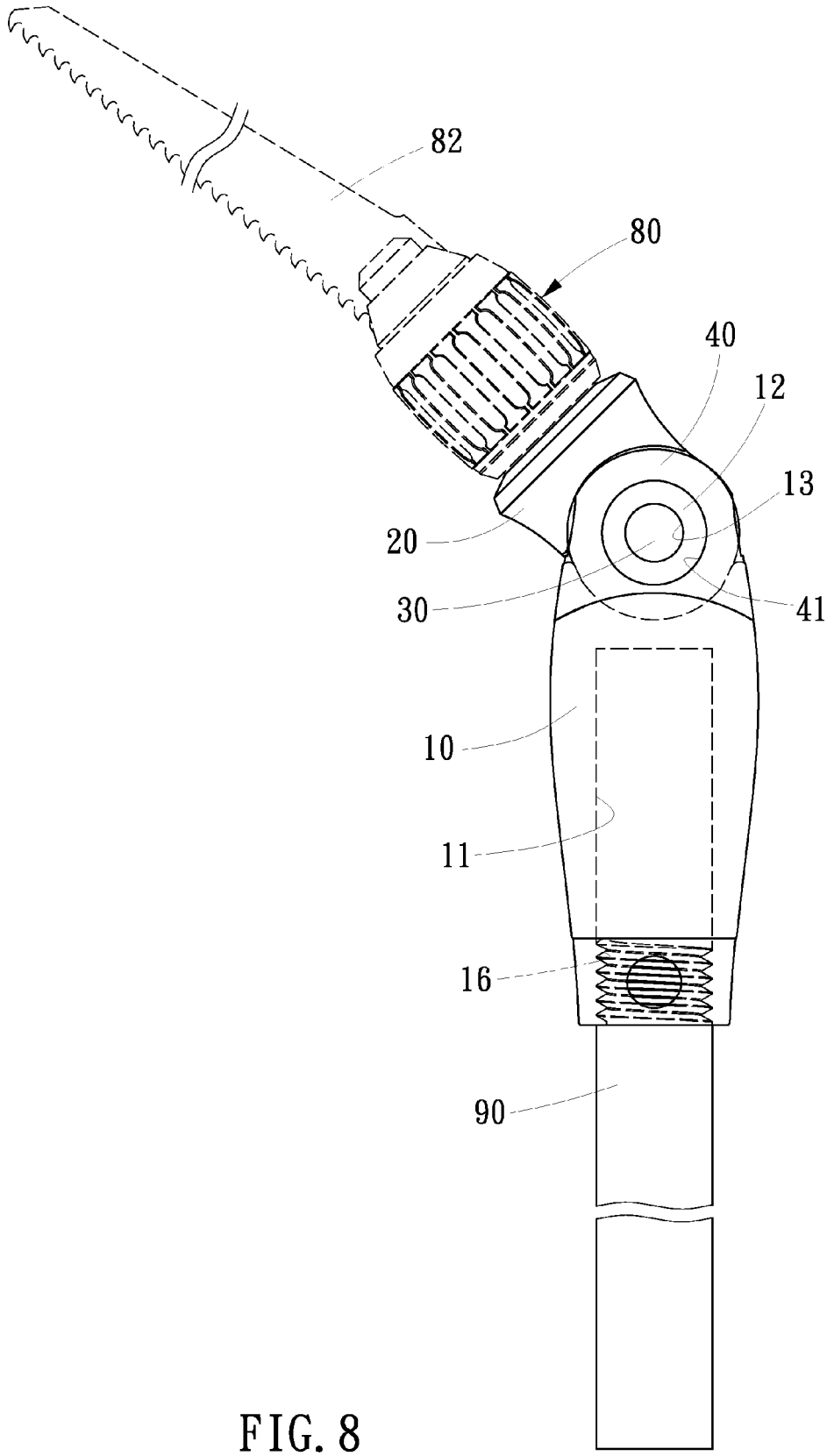
FIG. 8 is a side view of a saw held with the chuck connected to the handle unit shown in FIG. 4.

Referring to FIG. 8, a saw 82 is held with the chuck 80. The tail element 60 is detached from the handle 10. Instead, an extensive handle 90 is engaged with the handle 10. Thus, the saw 82, the handle unit and the extensive handle 90 together form a tool suitable for sawing things.

Figure 9:
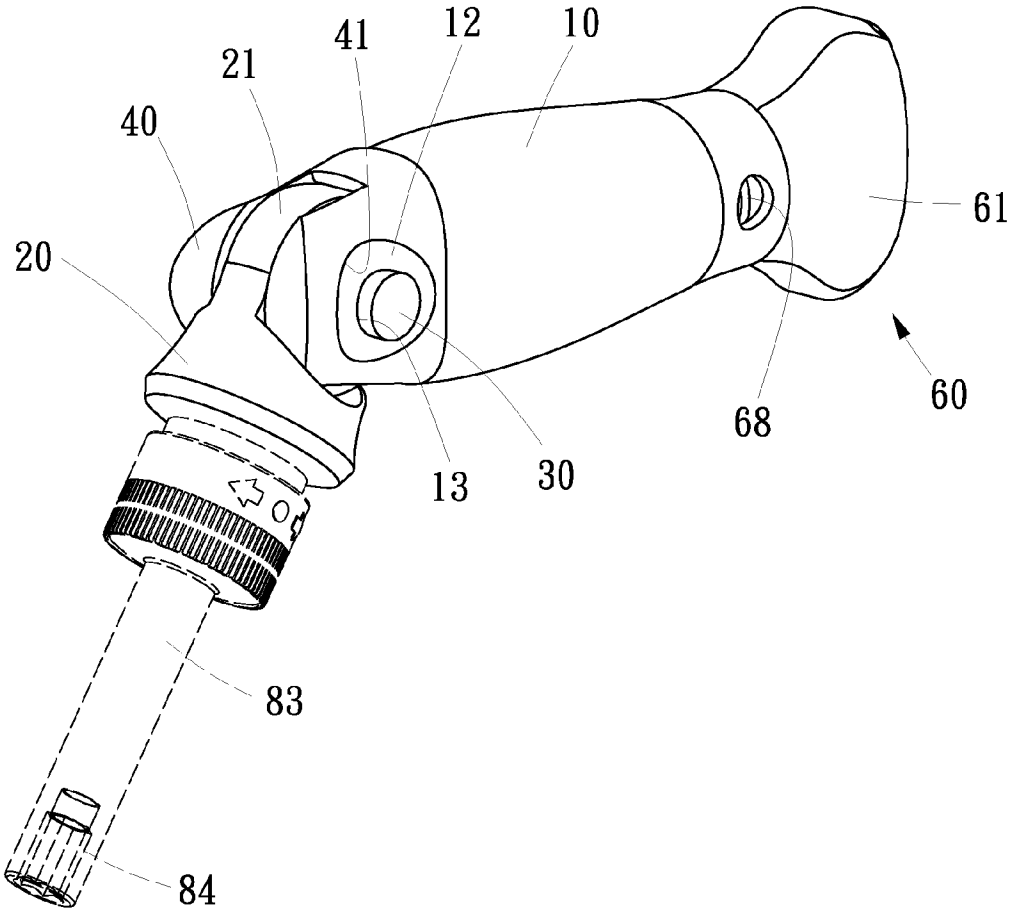
FIG. 9 is a perspective view of a socket held with the chuck connected to the handle unit shown in FIG. 4.

Referring to FIG. 9, a socket 83 is held with the chuck 80. Thus, socket 83 includes a non-circular and particularly hexagonal bore 84 for receiving another bit such as a screwdriver. Thus, the bit, the socket 83 and the handle unit together form a tool suitable for driving screws.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A handle unit comprising:

a handle including a first lug with a countersink and a second lug with a non-circular opening defined therein;

a connector including a lug with a non-circular opening defined therein, wherein the lug of the connector is located between the lugs of the handle;

a bolt inserted in the lugs so that the handle is pivotally connected to the connector;

a latch connected to the bolt and located in the non-circular opening of the handle;

a button connected to the bolt; and a spring compressed between the button and an annular shoulder formed in the countersink to make the latch partially enter the non-circular opening of the connector to position the connector relative to the handle, wherein the button can be pressed to make the latch leave the non-circular opening of the connector to allow rotation of the connector on the handle.

2. The handle unit according to claim 1, wherein the non-circular opening of the handle includes a circular aperture and cutouts in communication with the circular aperture thereof, wherein the non-circular opening of the connector includes a circular aperture and cutouts in communication with the circular aperture of the connector, wherein the latch includes ribs located in the cutouts of the handle and movable into the cutouts of the connector.

3. The handle unit according to claim 2 further including at least one spring-biased detent connected to the first lug of the handle, wherein the lug of the connector includes apertures for receiving the spring-biased detent to indicate that the ribs of the latch located in the cutouts of the handle are ready to partially enter the cutouts of the connector.

4. The handle unit according to claim 3, wherein the spring-biased detent includes a ball located against the lug of the connector and a spring compressed between the ball and the first lug of the handle.

5. The handle unit according to claim 1, wherein the handle includes a chamber defined therein.

6. The handle unit according to claim 5 further including a tail element for closing the chamber of the handle.

7. The handle unit according to claim 6, wherein the handle includes a thread formed thereon, wherein the tail element includes a thread engaged with the thread of the handle.

8. The handle unit according to claim 6, wherein the tail element includes a chamber defined therein.

9. The handle unit according to claim 8 further including a cover for closing the chamber of the tail element.

10. The handle unit according to claim 9, wherein the cover includes two flanges formed thereon, wherein the tail element includes two grooves for receiving the flanges.

11. The handle unit according to claim 10, wherein the cover includes a boss formed thereon, wherein the tail element includes a recess for receiving the boss to keep the cover on the tail element.

* * * * *